United States Patent [19]

Loechel

[11] 4,143,481

[45] Mar. 13, 1979

[54] EDUCATIONAL TOY

[76] Inventor: Stephen J. Loechel, Unit 2, 6 Bray Ave., Klemzig, South Australia, Australia, 5087

[21] Appl. No.: 750,697

[22] Filed: Dec. 15, 1976

[51] Int. Cl.[2] ..... A63H 33/08

[52] U.S. Cl. ..... 46/26

[58] Field of Search ..... 46/25, 26, 23, 29, 28

[56] References Cited

U.S. PATENT DOCUMENTS

| | | | |
|---|---|---|---|
| 669,029 | 2/1901 | Faller | 46/26 |
| 1,281,856 | 10/1918 | Shaw | 46/29 |
| 2,722,772 | 11/1955 | Steanes | 46/29 |
| 3,032,919 | 5/1962 | Amsler | 46/26 |
| 3,803,754 | 4/1974 | Fischer | 46/26 |
| 3,830,011 | 8/1974 | Ochrymowich | 46/29 |

FOREIGN PATENT DOCUMENTS

| | | | |
|---|---|---|---|
| 2203029 | 7/1973 | Fed. Rep. of Germany | 46/26 |
| 1145586 | 5/1957 | France | 46/26 |
| 1180316 | 12/1958 | France | 46/24 |

*Primary Examiner*—F. Barry Shay

*Attorney, Agent, or Firm*—Oldham, Oldham, Hudak & Weber Co.

[57] ABSTRACT

An educational toy comprised of a kit of parts, and including blocks having slots in their faces, and resilient strips to fit into the slots and adapted to be retained in the slots by bending of the strips.

5 Claims, 9 Drawing Figures

EDUCATIONAL TOY

This invention relates to an educational toy, and more particularly to a toy in the form of a construction kit whereby the various elements co-operate to fit together to form a desired structure.

With educational toys one of the objects is to provide a toy which will stimulate the imagination of the child in playing with the toy and to for example use the initiative and imagination of the child in forming and directing forms and structures from the various components of the toy which could be in kit form. The various portions of the toy in kit form should be easily fitted together and yet be such that they remain in position once fitted together.

Also it is felt that while these toys can comprise in their kit a large number of differing shapes or constructional elements, that further imagination and thought is stimulated if the kit or various features of the toy can comprise a minimum of differing constructional features and it is with this thought in mind that the present invention has been devised to provide.

Thus the present invention comprises a constructional toy comprising a plurality of blocks each having a groove slot or aperture in each of its faces, and a plurality of resilient elongated members adapted to interconnect the blocks by engaging in the slots or apertures, the elongated strips being so dimensioned with relation to the apertures that they are easily inserted therein but are retained in the slots or apertures.

Thus in one form of the blocks can each be a parallelepiped, with slots extending along the centre of each face so that in one form the vertical faces each have a slot extending the length of the face and through the centre thereof, and at the top and the bottom these slots extend across the top and bottom faces so that the top and bottom faces have a pair of intersecting slots while the vertical faces only have a vertical slot. Whether the block is of cubic form or whether the vertical side faces are twice the dimension of the end faces the similar arrangement of slots could be applied, it being preferred however, that the vertical faces be of a dimension twice the dimension of the end faces.

Figure 1:
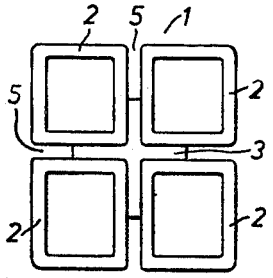
Figure 2:
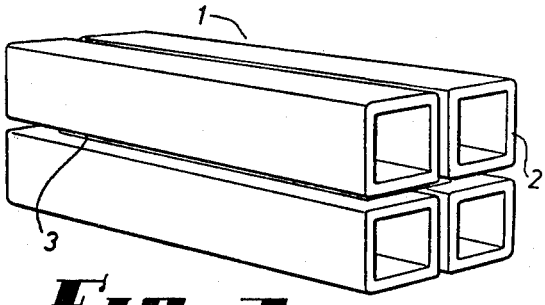
Figure 3:
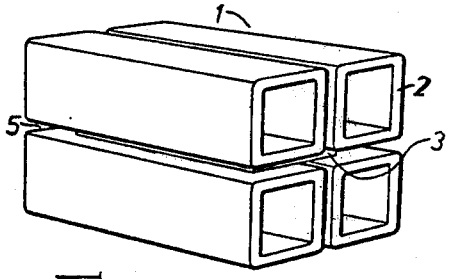
Figure 7:
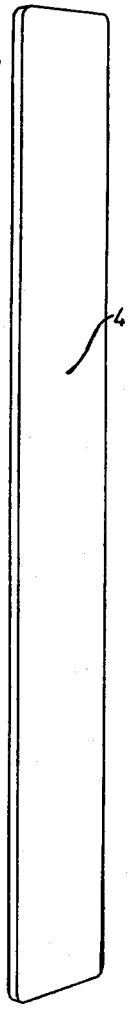
Figure 4:
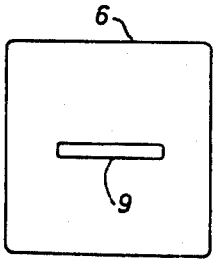
Figure 5:
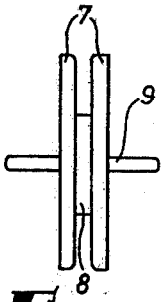
Figure 6:
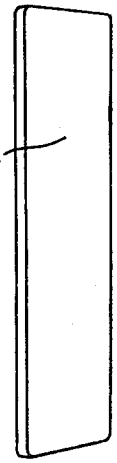
Figure 9:
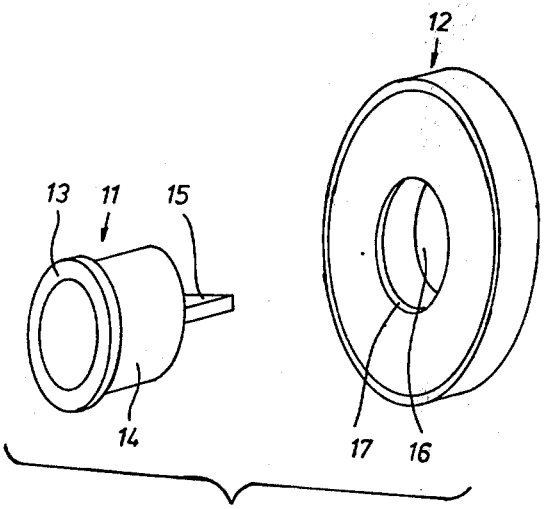
Figure 8:
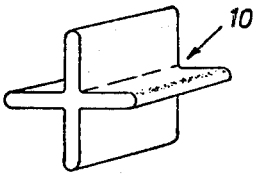

In order to more fully describe the invention, reference will now be made to the accompanying drawings in which, FIG. 1 is an end view of a block, FIG. 2 is a perspective view of the block of FIG. 1, FIG. 3 is a perspective view of a block of lesser length than the block of FIGS. 1 and 2, FIG. 4 is a side view of a connector, FIG. 5 is an end view of a connector, FIGS. 6 and 7 are perspective views of two alternate strips, FIG. 8 is a view of a star shaped connector, and FIG. 9 is an exploded view of a wheel and stub axle.

As shown in FIGS. 1 to 3, the block 1 which for convenience will be called a block even though it may not be of solid form, comprises four rectangular tubes 2 being joined by a solid cross-shaped joiner 3.

The tubes 2 are spaced from each other and equal distance to form slots 5, these being the width so that strips 4 can be snuggly received therein. The strips have a cross-sectional shape but the small dimension is received into the slot 5, while the slot 5 has a depth equal to half the larger dimension of the cross-section. Thus the cross-shaped joiner 3 extends half-way across the tubes 2.

At the ends the connector 3 does not extend to the end of the block 1, but is spaced from the ends a similar distance that is half the width of the tubes 2.

The strips 4 are thus dimensioned to snuggly fit into the slots 5, and it will be seen that with a plurality of blocks and strips that a variety of shapes and constructions can be formed.

It is important to note that the strips are also flexible so that curved shapes can be formed by for example, inserting two strips into opposite slots on a block, and bending the strips to enter opposite sides in a further block so that each strip is bent to a virtual semi-circular shape.

Also in this respect it is noted that if the two strips are inserted endwise into two adjacent slots in a block, and the other ends inserted into adjacent slots in a further block so that each strip is curved and an ellipsoidal shape can be formed.

FIGS. 4 and 5 show a connector piece 6, this including two plate members 7 joined by a spacer 8, each plate having a central half strip 9.

The plates 7 have a dimension equal to the cross-section of the blocks 1, while the half strips 9 are of a width of the strips 4 but are of a depth to be inserted into a slot 5 with plate 7 thus abutting the side or virtually abutting the end faces or sides of the tube 2.

FIG. 8 shows a cross-shaped connector 10, this being sized to be the same size as the joiner 3, but is used for connecting blocks 1 end to end. The length of the connector 10 is preferably equal to twice the depth of the slots 5, so that when used the blocks 1 can abut each other.

As shown in exploded form, FIG. 9 shows a stub axle 11 and wheel 12, the axle 11 having a flange 13 to which is joined the bearing portion 14. The bearing portion 14 terminates in a diametral blade 15 which is dimensioned to fit into a slot 5.

The wheel 12 has a central opening 16 which receives the bearing portion 14, and also a recess 17 to receive the flange, so that when assembled with the axle 11 in position that the outer edge of the flange is virtually flush with the wheel 12.

The axle 11 is thus only a stub axle in effect, and can be inserted into any slot as desired, either along the sides or across the ends of the block.

Preferably the wheel is dimensioned such that it has a diameter in excess of the width of the block so that the block is supported above the surface on which the wheel is resting.

The elongated resilient strips can be formed of any suitable material and this can be one of the suitable plastics materials such as high impact polystyrene or polypropylene. The blocks can be formed of any suitable material such as one of the rigid plastics material or if desired any of the foam plastics, whether of solid or cored section or even wood.

The blocks and connections and strips can be moulded or if desired, the blocks can be extended with the joiner cut away at the ends to form the end slots.

The blocks can be as above described and also the other side faces may have a further slot intersecting the vertical slot so that each of the faces has a pair of intersecting slots.

As noted above the slots and strips are so dimensioned that the slots will easily receive the end of a strip and in an example, to connect a pair of blocks a pair of strips are used, with the strips being bent so that on bending the strips the stresses imposed in the bent strips tend to deform the strip and thus hold the stip in its respective slot. For example in one block the ends of the two connecting strips are inserted in a pair of adjacent slots in adjacent parallel sides and the other ends similarly inserted in the other block and its co-operating slots so that the strips are bent and deformed in the general shape of an arc. If the strips instead of being inserted in adjacent faces are inserted in the opposite faces then the strips would be deformed to be generally semi-circular.

If for example one block has its strips inserted into adjacent faces and the other block into opposite faces then a generally heartshaped structure is formed.

It will be realised that by the position of the slots that the structure can be further expanded in a three dimensional form to whatever shape is desired.

While it is preferred that the invention be formed with blocks having slots and the interconnecting means being flexible strips, it is to be realised that the strips could be of rod like, for example circular construction and a plurality of holes be drilled in the blocks in each of faces and with this the rods would also be held in position due to the bending when a pair of rods is used to interconnect a pair of blocks with the rods interconnecting in different faces of the respective blocks.

Thus a further development could be that the blocks instead of being parallelepiped construction could for example be spheres with the interconnecting elements being circular rods to engage in holes formed in the spheres. In this instance preferably the rods would be of an easy fit into the holes but would be retained therein due to the bending and flexing of the rods due to the stresses imparted into the rods when a pair of rods interconnects a pair of spheres.

Although various forms of the invention have been described in some detail it is to be realised that various alterations and alternatives may be made thereto without departing from the spirit and scope of the invention.

I claim:

1. An educational toy, the toy comprising at least a pair of blocks each having at least one slot in a plurality of faces of the block, each said block being formed of four square tubes of equal size connected in parallel laterally aligned relation by a cross-shaped joiner piece, said joiner piece having four legs of equal size and having a respective square tube positioned in each quadrant of the joiner piece and extending beyond the free ends of the legs forming said quadrant, said legs thus determining the spacing between the tubes to form the slots and also determining the depth of the slots, and at least one strip dimensioned such that the strips are snugly received in said slots, each said strip being flexible and such that when said strip interconnects a slot in each of two blocks positioned so that the respective slots are non planar, the strips are deflected and stressed to lock in said slots.

2. An educational toy as defined in claim 1 and including a joining piece formed by a pair of parallel plates joined by a planar spacer parallel to and attached to the faces of said plates, each plate having a half width strip attached thereto to protrude therefrom at right angles, the half strips being in a common plane to be adapted to be inserted in the slots of the blocks.

3. An educational toy as defined in claim 1, and including a cross-shaped connector piece, the cross-shaped connector piece fitting into the cross-shaped end slots of the block to connect a pair of blocks in end to end relation.

4. An educational toy, the toy comprising at least a pair of blocks each having at least one slot in a plurality of faces of the block, each said block being formed of four square tubes of equal size connected in parallel laterally aligned relation by a cross-shaped joiner piece, said joiner piece having four legs of equal size and having a respective square tube positioned in each quadrant of the joiner piece and extending beyond the free ends of the legs forming said quadrant, said legs thus determining the spacing between the tubes to form the slots and also determining the depth of the slots, said cross-shaped joiner piece being shorter than said square tubes all of which are of equal length so as to form end slots in said blocks, and a cross-shaped connector piece, the cross-shaped connector piece fitting into the cross-shaped end slots of the blocks to connect a pair of blocks in end to end relation.

5. An educational toy as defined in claim 4 and including a joining piece formed by a pair of parallel plates joined by a planar spacer parallel to and attached to the faces of said plates, each plate having a half width strip attached thereto to protrude therefrom at right angles, the half strips being in a common plane to be adapted to be inserted in the slots of the blocks.

* * * * *